US010196246B2

(12) United States Patent
Gebele

(10) Patent No.: US 10,196,246 B2
(45) Date of Patent: Feb. 5, 2019

(54) HYDRAULIC CONTROL CIRCUIT FOR CRANE SLEWING GEAR

(71) Applicant: Liebherr-Werk Ehingen GmbH, Ehingen (DE)

(72) Inventor: Joerg Gebele, Ulm (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 155 days.

(21) Appl. No.: 15/448,516

(22) Filed: Mar. 2, 2017

(65) Prior Publication Data

US 2017/0253468 A1 Sep. 7, 2017

(30) Foreign Application Priority Data

Mar. 3, 2016 (DE) ..... 10 2016 002 613

(51) Int. Cl.

| | |
|---|---|
| ***F15B 11/10*** | (2006.01) |
| ***B66C 23/86*** | (2006.01) |
| ***F15B 11/044*** | (2006.01) |
| ***F15B 13/02*** | (2006.01) |

(52) U.S. Cl.

CPC ..... *B66C 23/86* (2013.01); *F15B 11/044* (2013.01); *F15B 11/10* (2013.01); *F15B 13/024* (2013.01); *F15B 13/027* (2013.01); *F15B 2211/30* (2013.01); *F15B 2211/3053* (2013.01); *F15B 2211/30505* (2013.01); *F15B 2211/3144* (2013.01); *F15B 2211/351* (2013.01); *F15B 2211/40561* (2013.01); *F15B 2211/41554* (2013.01); *F15B 2211/455* (2013.01); *F15B 2211/46* (2013.01); *F15B 2211/50572* (2013.01); *F15B 2211/5156* (2013.01); *F15B 2211/5157* (2013.01); *F15B 2211/55* (2013.01); *F15B 2211/5753* (2013.01); *F15B 2211/6658* (2013.01); *F15B 2211/7058* (2013.01); *F15B 2211/715* (2013.01)

(58) Field of Classification Search

CPC ..... B66C 23/86; F15B 11/044; F15B 11/10; F15B 2211/47; F15B 2211/30424; F15B 13/024

USPC ..... 60/493

See application file for complete search history.

(56) References Cited

U.S. PATENT DOCUMENTS

2010/0263364 A1 10/2010 Tsutsui et al.

FOREIGN PATENT DOCUMENTS

| | | |
|---|---|---|
| DE | 102006040459 B4 | 12/2012 |
| WO | 2009062484 A1 | 5/2009 |

*Primary Examiner* — Thomas E Lazo
*Assistant Examiner* — Daniel S Collins
(74) *Attorney, Agent, or Firm* — McCoy Russell LLP

(57) ABSTRACT

The present disclosure relates to a hydraulic control circuit for crane slewing gear having directional valves arranged in work lines and controllable separately for the inflow and outflow to the hydraulic motor for the carrying out of a rotational movement of the slewing gear, wherein an inflow valve serves the control of the oil inflow from a hydraulic pump via the work line to the hydraulic motor and an outflow valve is provided via which the hydraulic motor can be relieved to the tank, wherein the work lines are each connected via at least one check valve to a common inlet of the outflow valve to relieve the hydraulic motor independently of the direction of rotation of the slewing gear via an outflow valve into the tank.

18 Claims, 1 Drawing Sheet

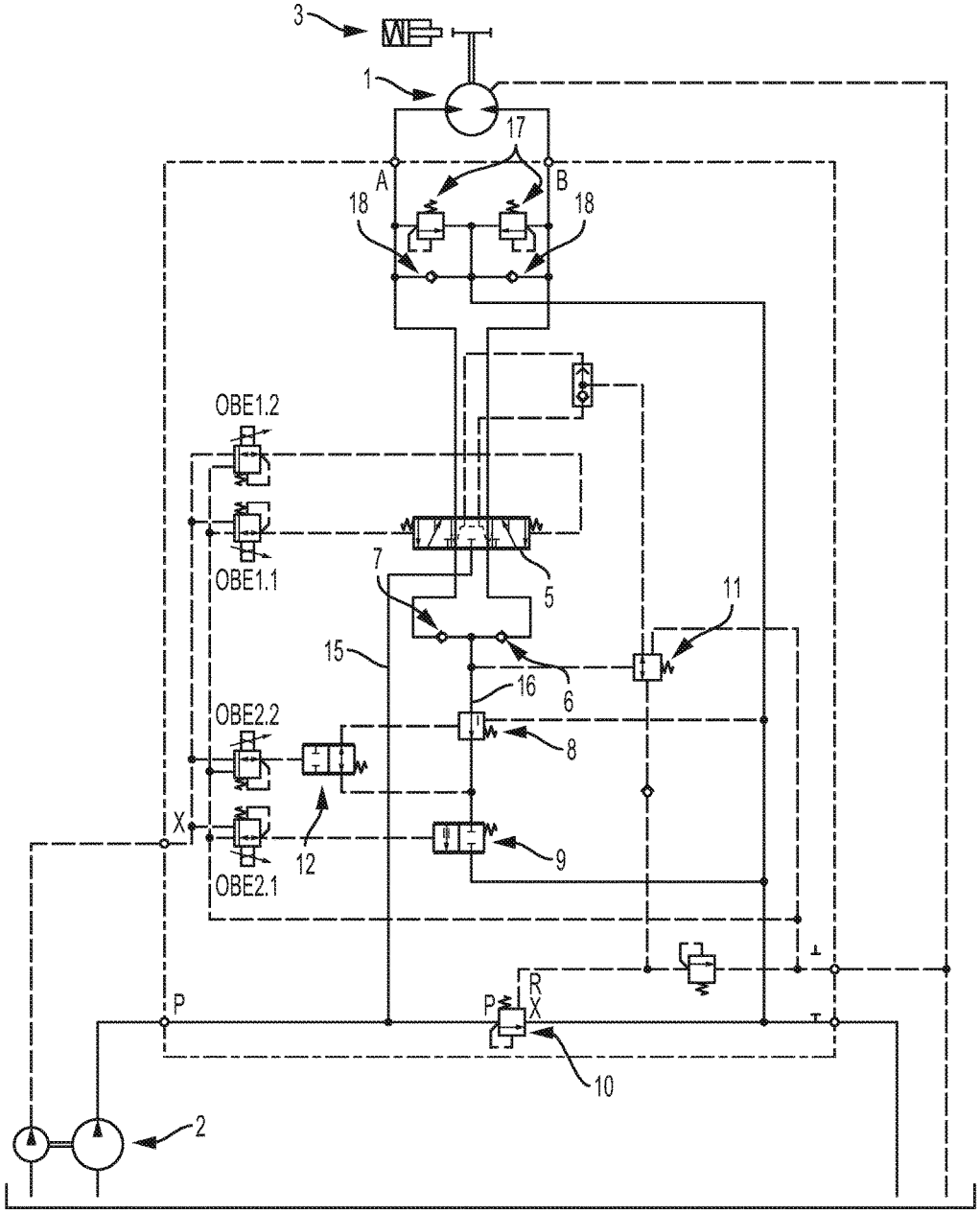
3
1
17
A
B
18
18
OBE1.2
OBE1.1
7
5
11
15
16
6
OBE2.2
8
X
12
9
OBE2.1
P
R
P
X
10
2

HYDRAULIC CONTROL CIRCUIT FOR CRANE SLEWING GEAR

CROSS REFERENCE TO RELATED APPLICATION

This application claims priority to German Patent Application No. 10 2016 002 613.8 , entitled "Hydraulic Control Circuit for Crane Slewing Gear," filed Mar. 3, 2016, the contents of which are hereby incorporated by reference in its entirety for all purposes.

TECHNICAL FIELD

The present disclosure relates to a hydraulic control circuit for crane slewing gear having directional valves arranged in work lines and separately controllable for the inlet to and outlet from the hydraulic motor.

BACKGROUND AND SUMMARY

Slewing gear is required in construction machinery to rotate the superstructure relative to the undercarriage. A plurality of, occasionally contradictory, demands are made on the control of slewing gear of a mobile crane. In simple crane operation, also in transfer operation, the "freewheeling" mode is desirable. The slewing gear is first controlled and driven by a hydraulic motor. The slewing gear coasts freely once the control is removed. A swinging of the load is thereby very largely avoided and a jerk-free operation is possible in a simple manner. The slewing gear can be braked hydraulically as required by a direct counter-steering.

With an increased demand on the positioning accuracy or in the case of a limitation of the rotation range, the "clamped" mode is desirable. The change of the slew angle here follows the change of the control. An exact positioning of the superstructure with respect to the slew angle hereby becomes possible and an unwanted turning away by external influences is prevented. On a less observant control, however, the slewing gear tends to unsteadiness and the load tends to swing so that greater care is required in operation.

To combine the advantages of both modes, a continuous transition of the one mode into the other mode is desirable that depends on the situation. In addition, a wear-free braking of the superstructure is desired, for example by a foot-brake pedal or by counter-steering with the aid of the control lever of the slewing gear. When taking up the load, the boom should furthermore be able to pulled via the load at the initial oblique pull of the hoisting gear by a free rotation of the superstructure in order then to be able to lift said load without oblique pull.

In the common slewing gears or hydraulic control circuits, an advance selection of the mode in which the slewing gear is to be operated must be made. Current combination slewing gears allow a switchover of the modes in standstill operation. In the "freewheeling" mode, the oil running down from the hydraulic motor is connected to the tank via the tank edge of the valve. In the "clamped" mode, the slewing gear is prevented from turning away by a respective load-lowering valve. This currently used combination slewing gear has the main disadvantage that the mode selection has to take place in stationary operation. In the restricting of the work range, the mode "clamped" has to be selected for the total rotational range, even in ranges in which "freewheeling" would be possible. The installed load-lowering valves allow an exact stopping and prevent a breaking away, but increase the manufacturing and service costs of the hydraulics.

Solutions are also known that use separate valves for oil flowing in and out of the hydraulic motor, with one valve, i.e. in sum at least two valves, being used in the outlet flow for each direction of rotation of the slewing gear. A load-independent quantity regulation is admittedly thereby enabled in the inflow, but an outflowing oil quantity disadvantageously results in the outflow that is dependent on the valve opening and on the current load pressure. A braking with great precision is thus only possible with limitations and in reduced quality. A further problematic point is the coordination of the characteristics between the inflow and outflow valves. In practice, they can only be coordinated with one another with a high effort with the limited precision. As a result, the pressure at the inflow valve and at the primary pressure limit will rapidly increase to the maximum system pressure on braking by closing one of the outflow valves, which in turn has the consequence of imprecise handling, pressure peaks, reduction in the diesel engine speed and noise. In addition, the outflow valves for the different directions of rotation of the slewing gear will always differ in the characteristics due to tolerances, which may mean further coordination effort.

It is the object of the present disclosure to provide a hydraulic control for a slewing gear that is able to overcome the aforesaid disadvantages.

This object is achieved by a hydraulic control circuit for crane slewing gear, the hydraulic control circuit having directional valves arranged in work lines and controllable separately for inflow and outflow to a hydraulic motor for carrying out a rotational movement of the slewing gear, wherein an inflow valve is provided for control of oil inflow from a hydraulic pump via a work line to the hydraulic motor and an outflow valve is provided via which the hydraulic motor is relieved to the tank, wherein the work lines are each connected via at least one check valve to a common inlet of the outflow valve to relieve the hydraulic motor independently of the direction of rotation of the slewing gear via the outflow valve into the tank. Advantageous embodiments of the hydraulic control circuit in accordance with the present disclosure are the subject of the dependent claims.

In accordance with the present disclosure, a hydraulic control circuit is proposed that allows a directional valve for controlling the pressure inflow from a hydraulic pump via the working line to the hydraulic motor and comprises an outflow valve to control the pressure relief from the hydraulic motor to the tank. The one outflow valve is used independently of the direction of rotation; as a result, an embodiment having two outflow valves per direction of rotation of the slewing gear can be dispensed with. Instead a common outflow valve is used. The coordination effort between the two outflow valves is thereby omitted and in addition the required parts of the total system are reduced, which produces a substantial reduction in the costs of manufacture, production and servicing.

To be able to use one outflow valve for both directions of rotation of the slewing gear, the work lines from the hydraulic motor are connected to the inlet of the outflow valve via at least one respective check valve. The check valves prevent the backflow from the outflow valve to the hydraulic motor for every direction of rotation of the slewing gear.

The inflow valve may be connected such that it takes over a points function for the oil running off from the hydraulic motor. It is ensured in this manner that the return to the hydraulic motor is always connected to the outflow valve independently of the direction. In accordance with an optional embodiment, each outflow outlet of the inflow valve is for this purpose connected to the common inlet of the outflow valve via a check valve. In this configuration, the outflow from the hydraulic motor to the tank is released via the inflow valve, with the one or other work line to the tank selectively being able to be relieved. The respective outlets are connected to the outflow valve via check valves to block a flowing back of the hydraulic medium from the outflow valve in the direction of the inflow valve.

At least one inflow pressure maintenance valve may be provided in the pressure inflow direction before the inflow valve, in particular a three-way pressure maintenance valve, whereby a load pressure-independent oil quantity is ensured in the inflow to the hydraulic motor. Pressure fluctuations in the inflow to the hydraulic motor are compensated by the pressure maintenance valve and a constant volume flow through the inflow valve is always ensured that only depends on the opening cross-section of the inflow valve.

Alternatively or additionally, at least one outflow pressure maintenance valve can also be provided in the outflow direction in front of the outflow valve. This may be arranged between the inflow valve and the outflow valve, ideally between the check valves and the outflow valve. The pressure difference can be kept constant over the outflow valve by the pressure maintenance valve, whereby a load pressure-dependent oil quantity is ensured in the outflow, which decisively increases the positioning accuracy of the slewing gear.

The outflow valve can ideally be opened and/or closed proportionally. It is conceivable that it is possible to change between the operating modes "freewheeling" and "clamped" of the hydraulic control circuit by the proportional actuation possibility of the outflow valve, i.e. by a proportional opening or closing of the outflow valve. The quantity regulation in the outflow is unwanted in the "freewheeling" mode. The pressure difference over the outflow valve is smaller than the regulation pressure difference of the outflow pressure maintenance valve by the direct setting of the opening cross-section at the outflow valve, and the regulation pressure difference of the pressure maintenance valve at the outflow valve can no longer be reached. Due to this, the outflow pressure maintenance valve opens completely and thus stops functioning. As the end result, a mode "freewheeling" is thereby achieved; it is consequently possible to change continuously between the modes "freewheeling" and "clamped" by a proportional opening and closing of the outflow valve.

It is conceivable that, in accordance with an advantageous embodiment, at least one pressure regulation valve is connected to the inflow pressure maintenance valve. This pressure regulation valve should prevent an unwanted pressure increase at the inflow pressure maintenance valve. For example, a closing of the outflow valve in the "clamped" mode effects a pressure increase at the inflow pressure maintenance valve, whereby the pump pressure can quickly reach the maximum system pressure in this operating mode in dependence on the degree of opening of the outflow valve. In order simultaneously to avoid a complex programming, comparing and regulating of the opening characteristics of the inflow and outflow valves, the at least one pressure regulation valve is integrated in accordance with this advantageous embodiment to prevent an increase of the pump pressure at the inflow pressure maintenance valve in a purely hydraulic manner.

In accordance with an advantageous embodiment, the pressure regulation valve for this purpose influences the load pressure picked up at the inflow valve such that no higher pressure than the pressure value set at the pressure regulation valve arises in front of the outflow pressure maintenance valve. A reduction in the engine speed triggered by the high or maximum system pressure is efficiently prevented by this measure. In the final effect, fuel is saved and the operating costs incurred and disturbing noises can be reduced.

It is particularly desirable if the outflow pressure maintenance valve can be directly deactivated via an additional valve. This is in particular desirable for the "freewheeling" mode. The deactivation can be achieved by at least one adding valve that in particular switches, in particular interrupts, the pressure feedback line of the outlet pressure of the pressure maintenance valve to deactivate the basic function of the outflow pressure maintenance valve.

A braking torque can thus be built up in the "freewheeling" operating mode by the deactivation of the outflow pressure maintenance valve and a simultaneous control of the outflow valve, in particular a restricting of the outflow valve. The volume flow in the outflow from the hydraulic motor is controlled, in particular reduced, by the restriction actuation of the outflow valve, which produces an effective and wear-free braking of the rotary movement of the slewing gear.

A corresponding restriction actuation of the outflow valve may be produced by a movement of the joystick for the slewing gear direction against the direction of rotation. Alternatively or additionally, the actuation of at least one foot brake pedal is possible.

It is conceivable that the previously named valves, in particular the pressure reducing valves, can be controlled directly via a central control via integrated on-board electronics with an additional bus interface. The conventional CAN interface has in this respect proved to be a suitable bus interface.

In addition to the hydraulic control circuit in accordance with the present disclosure, the present disclosure likewise comprises slewing gear that is characterized by at least one hydraulic control circuit in accordance with the present disclosure. The same advantages and properties as were previously discussed in detail with reference to the hydraulic control circuit in accordance with the present disclosure thus apply to the slewing gear. A repetitive description is dispensed with for this reason.

The present disclosure likewise comprises a crane, in particular a mobile crane or crawler-mounted crane, that comprises at least one hydraulic control circuit in accordance with the present disclosure and/or slewing gear in accordance with the present disclosure. The same advantages and properties in accordance with the hydraulic control circuit in accordance with the present disclosure also apply in this respect.

Further advantages and properties of the present disclosure will be explained in detail in the following with reference to an embodiment shown in the drawing.

BRIEF DESCRIPTION OF THE FIGURE

FIG. 1 shows a hydraulic circuit diagram of the hydraulic control circuit in accordance with the present disclosure for the control of crane slewing gear.

DETAILED DESCRIPTION

A main component of the hydraulic control circuit is the main pump 2 for driving the slewing gear. This main pump 2 is driven via an engine, in particular a diesel engine of a crane. The hydraulic motor 1 that is supplied with the required operating pressure from the main pump 2 via the work lines A, B serves the carrying out of the rotational movement of the slewing gear. Depending on the direction of rotation of the slewing gear, either work line A or, alternatively, work line B is acted on by the desired pressure level while the hydraulic motor is relieved via the pressure-free work line A, B toward the tank.

The hydraulic control circuit in accordance with the present disclosure offers a slewing gear control that works in both directions, driving or driven, regulated both by quantity and by pressure. All conceivable control demands can thereby be covered by only one single hydraulic slewing gear control. This is achieved in that the pressure inflow of the hydraulic motor is controllable via a single inflow valve 5 and the pressure outflow is controllable via an outflow valve 9. In addition, a load-independent oil quantity can be ensured both in the inflow 15 and in the outflow 16 by integration of the inflow pressure maintenance valve 10 and of the outflow pressure maintenance valve 8.

The exact operating mode of the hydraulic control circuit will be described in more detail in the following. The slewing gear direction is connected via the inflow valve 5. In the neutral position, as shown in the single FIGURE, both work lines A, B are blocked via the directional check valves 6, 7 and by the outflow valve 9 toward the tank. The slewing gear is fixed by it in addition to the stop brake. If the outflow valve 9 is controlled to open, the slewing gear can move freely. The neutral position is generally also conceivable with an open outflow valve 9; then with a reverse control. It can be recognized that the two work lines A, B are combined to form a common outflow line 16 via the check valves 6, 7. The use of a common outflow valve 8 for both directions of rotation is thereby made possible at all.

The inflow valve 5 is brought into the first or third switch position to carry out a rotational movement, whereby either the work line A or the work line B is acted on by the required system pressure of the main pump 2. The integration of the three-way pressure maintenance valve 10 provides a load-independent oil quantity in the inflow 15 through the inflow valve 5. A system pressure limitation is achieved via the valves 17. The two check valves 18 serve as re-suction valves.

At the same time, the inflow valve 5 switches the outflow line of the hydraulic motor 1 free via the directional check valves 6, 7 and the outflow valve 9 to the tank. The integration of the outflow pressure maintenance valve 8 provides that the pressure difference over the outflow valve 9 is always constant such that the outflow quantity only depends on the opening of the outflow valve 9 itself. The outflow valve 9 is for this purpose a proportionally switchable outflow valve 9 with a variable adjustable flow quantity.

The function of the outflow pressure maintenance valve 8 can be taken out of operation via the adding valve 12 in that the return of the outlet pressure is interrupted. This is in particular desirable for the "freewheeling" mode in order here to be able to introduce a possible braking torque onto the slewing gear by a direct restriction of the outflow valve 9. A mechanical brake 3 can additionally also be available for applying a braking torque onto the slewing gear.

To avoid the pump pressure of the main pump 2 quickly reaching the maximum system pressure on the closing of the outflow valve 9 in the "clamped" mode, a pressure regulation valve 11 purely hydraulically prevents an increase of the pump pressure at the three-way pressure maintenance valve 10. The pressure regulation valve 11 for this purpose influences the load pressure picked up at the inflow valve 5 such that no higher pressure arises at the outflow pressure maintenance valve 8 than the pressure value set at the pressure regulation valve 11. A reduction of the diesel engine speed of the drive unit through the main pump 2 is thus avoided and no unnecessarily high pump pressure is produced, which helps save fuel and costs and reduces noise.

In the "clamped" mode, the slewing gear is delayed in a quantity regulated manner and with great precision by closing the outflow valve with an active outflow pressure maintenance valve 8. The switchover of the different operating modes is achieved in that the quantity regulation is deactivated in the outflow in the "freewheeling" mode. In this mode, the outflow valve 9 is opened further until the regulation pressure difference of the pressure maintenance valve 8 can no longer be reached at the outflow valve 9. The pressure maintenance valve 8 thus opens fully and is thus out of operation. It is thus possible to change continuously between the modes "freewheeling" and "clamped" by a proportional opening and closing of the outflow valve 9.

The invenion claimed is:

1. A hydraulic control circuit for crane slewing gear having directional valves arranged in work lines and controllable separately for inflow and outflow to a hydraulic motor for carrying out a rotational movement of the slewing gear, wherein an inflow valve is provided for control of oil inflow from a hydraulic pump via a work line to the hydraulic motor and an outflow valve is provided via which the hydraulic motor is relieved to the tank, wherein the work lines are each connected via at least one check valve to a common inlet of the outflow valve to relieve the hydraulic motor independently of the direction of rotation of the slewing gear via the outflow valve into the tank.

2. The hydraulic control circuit in accordance with claim 1, wherein at least one inflow pressure maintenance valve is provided before the inflow valve in the direction of flow to ensure a load pressure-independent oil quantity in the inflow to the hydraulic motor.

3. The hydraulic control circuit in accordance with claim 1, wherein at least one outflow pressure maintenance valve is provided before the outflow valve in the direction of flow to keep the pressure difference over the outflow valve constant and to ensure a load pressure-independent oil quantity in the outflow.

4. The hydraulic control circuit in accordance with claim 1, wherein the outflow valve is opened and/or closed proportionally and is changeable between freewheeling and clamped operating modes of the hydraulic control circuit by a proportional opening and closing of the outflow valve.

5. The hydraulic control circuit in accordance with claim 3, wherein the outflow valve is controlled by a larger volume flow than the inflow valve, whereby the outflow pressure maintenance valve is completely opened and the control circuit is switched into the freewheeling operating mode.

6. The hydraulic control circuit in accordance with claim 2, wherein a pressure regulation valve is connected to the inflow pressure maintenance valve to limit or fully prevent an increase in the pressure at the inflow pressure maintenance valve caused by closing the outflow valve.

7. The hydraulic control circuit in accordance with claim 6, wherein the load pressure taken up at the inflow valve is influenced by the pressure regulation valve.

8. The hydraulic control circuit in accordance with claim 3, wherein the outflow pressure regulation valve is deactivated via an adding valve.

9. The hydraulic control circuit in accordance with claim 8, wherein a braking torque is built up in the freewheeling operating mode by restricting the outflow valve, with a restriction actuation of the outflow valve taking place by a movement of a joystick opposite to the direction of rotation and/or by actuating a foot brake pedal.

10. The hydraulic control circuit in accordance with claim 1, wherein all or at least some of the valves are controlled via on-board electronics having an integrated BUS interface.

11. A slewing gear having at least one hydraulic control circuit, the hydraulic control circuit having directional valves arranged in work lines and controllable separately for inflow and outflow to a hydraulic motor for carrying out a rotational movement of the slewing gear, wherein an inflow valve is provided for control of oil inflow from a hydraulic pump via a work line to the hydraulic motor and an outflow valve is provided via which the hydraulic motor is relieved to the tank, wherein the work lines are each connected via at least one check valve to a common inlet of the outflow valve to relieve the hydraulic motor independently of the direction of rotation of the slewing gear via the outflow valve into the tank.

12. A crane having a hydraulic control circuit, wherein the hydraulic control circuit has directional valves arranged in work lines and controllable separately for inflow and outflow to a hydraulic motor for carrying out a rotational movement of the slewing gear, wherein an inflow valve is provided for control of oil inflow from a hydraulic pump via a work line to the hydraulic motor and an outflow valve is provided via which the hydraulic motor is relieved to the tank, wherein the work lines are each connected via at least one check valve to a common inlet of the outflow valve to relieve the hydraulic motor independently of the direction of rotation of the slewing gear via the outflow valve into the tank.

13. The hydraulic control circuit in accordance with claim 2, wherein the at least one inflow pressure maintenance valve is a three-way pressure maintenance valve.

14. The hydraulic control circuit in accordance with claim 7, wherein the influence of the pressure regulation valve is such that no higher pressure is present before the outflow pressure maintenance valve than a set pressure value of the pressure regulation valve.

15. The hydraulic control circuit in accordance with claim 8, wherein the outflow pressure regulation valve is deactivated in a manner that feedback of the outlet pressure of the pressure maintenance valve is interrupted by the adding valve.

16. The hydraulic control circuit in accordance with claim 10, wherein the BUS interface is a CAN interface.

17. The crane in accordance with claim 12, wherein the crane is a mobile crane or a crawler mounted crane.

18. The crane in accordance with claim 12, further comprising a slewing gear.

* * * * *